United States Patent [19]

Bubik et al.

[11] Patent Number: 5,061,347

[45] Date of Patent: Oct. 29, 1991

[54] ADJUSTABLE LEDGE FOR THE SHEET FORMING ZONE OF A PAPERMAKING MACHINE

[75] Inventors: Alfred Bubik, Ravensburg; Otto Hildebrand, Ravensburg; Herbert Holik, Ravensburg-Taldorf; Karl Müller, Ringgenweiler, all of Fed. Rep. of Germany

[73] Assignee: Sulzer-Escher Wyss GmbH, Ravensburg, Fed. Rep. of Germany

[21] Appl. No.: 550,479

[22] Filed: Jul. 10, 1990

[30] Foreign Application Priority Data

Sep. 2, 1989 [DE] Fed. Rep. of Germany ..... 3929265

[51] Int. Cl.[5] ..... D21F 1/54

[52] U.S. Cl. ..... 162/301; 162/300; 162/352

[58] Field of Search ..... 162/300, 301, 303, 352, 162/374, 348

[56] References Cited

U.S. PATENT DOCUMENTS

| | | | |
|---|---|---|---|
| 3,017,930 | 1/1962 | Dunlap | 162/352 |
| 3,446,702 | 5/1969 | Buchanan | 162/352 |
| 3,585,105 | 6/1971 | Stuebe | 162/352 |
| 4,447,295 | 5/1984 | Bubik et al. | 162/300 |
| 4,648,943 | 3/1987 | Malashenko et al. | 162/352 |
| 4,767,111 | 9/1988 | Nevalainen et al. | 162/352 |
| 4,865,692 | 9/1989 | Kade et al. | 162/352 |

FOREIGN PATENT DOCUMENTS

| | | | |
|---|---|---|---|
| 0160615 | 6/1985 | European Pat. Off. . | |
| 177439 | 10/1985 | European Pat. Off. | 162/301 |
| 3153305 | 10/1986 | Fed. Rep. of Germany | 162/301 |
| 3503242 | 6/1988 | Fed. Rep. of Germany . | |
| 3800801 | 1/1989 | Fed. Rep. of Germany . | |
| 3830683 | 5/1989 | Fed. Rep. of Germany . | |
| 3815316 | 11/1989 | Fed. Rep. of Germany . | |
| 89/02499 | 3/1989 | PCT Int'l Appl. | 162/301 |

*Primary Examiner*—Karen M. Hastings

*Attorney, Agent, or Firm*—Sandler, Greenblum & Bernstein

[57] ABSTRACT

The ledge is arranged transverse to the machine direction in a substantially flexure resistant manner and is adjustable for guiding the wires between which a web of material is formed. The ledge contains a guide surface which faces the wires and has a special contour. For improved control of the pressure changes occurring in the region of the ledge, the ledge contains a supporting member and a pressing member which contains the guide surface. A pressing device is supported at the supporting member and the pressing member can be adjusted in a direction relative to the wires as well as relative to the supporting member by using the pressing device for simultaneously elevating the pressing member and inclining the pressing member with respect to the machine direction. Advantageously the pressing device constitutes a hose which is subjected to a pressurizing medium and thereby deformable. The hose is at least partially imbedded into the supporting member such that its deformation causes movement of the pressing member. For simultaneously inclining the pressing member during such movement, a connecting member is provided between the pressing member and the supporting member. The ledge permits the adjustment of optimum pressures along a sheet forming zone whereby the sheet formation is improved.

12 Claims, 1 Drawing Sheet

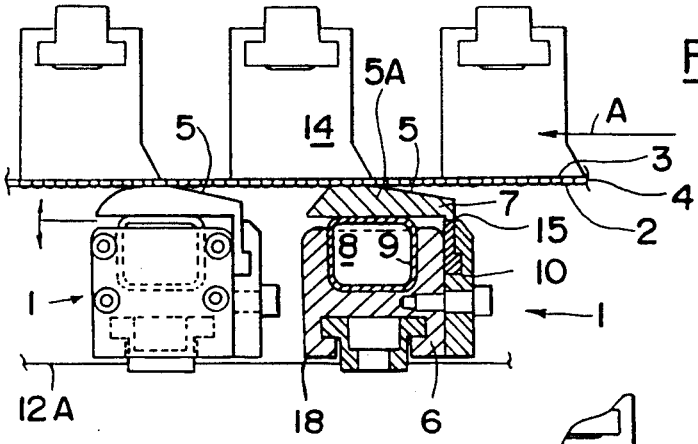
Fig- 1
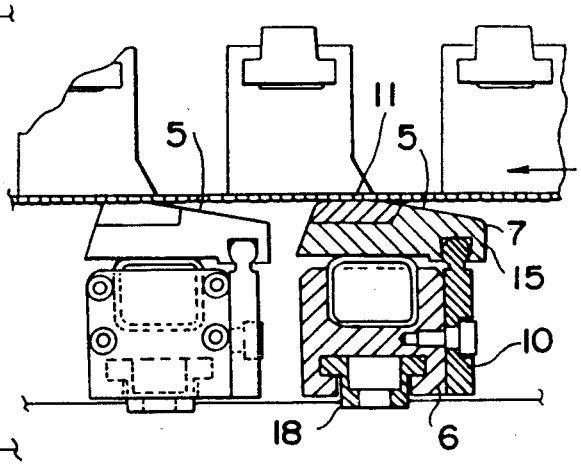
Fig- 2
Fig- 3
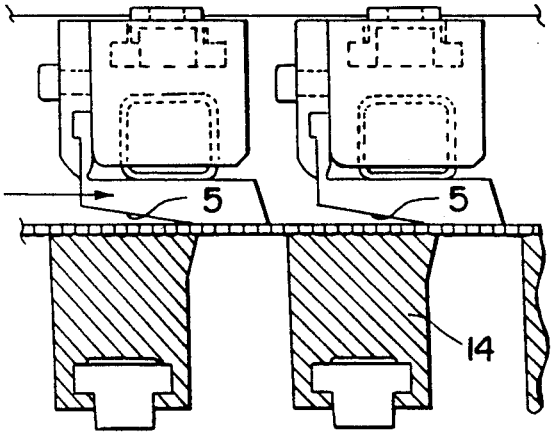
Fig- 4
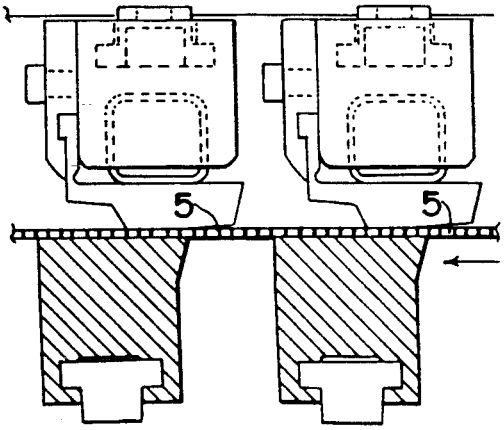
Fig- 5
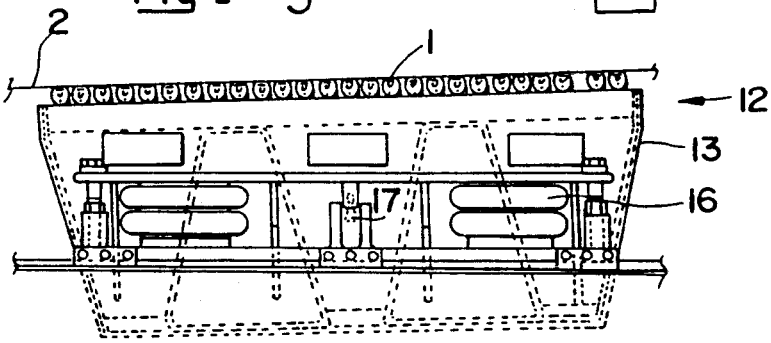

ADJUSTABLE LEDGE FOR THE SHEET FORMING ZONE OF A PAPERMAKING MACHINE

CROSS-REFERENCE TO RELATED APPLICATION

This application is related to the commonly assigned, copending U.S. application Ser. No. 07/391,573, filed June 26, 1989, and entitled "DOUBLE WIRE PRESS".

BACKGROUND OF THE INVENTION

The present invention broadly relates to a new and improved construction of a ledge or ledge arrangement for a sheet forming zone of a double wire papermaking machine. The present invention further relates to a new and improved construction of a pressing unit for a double wire former of a papermaking machine.

In its more particular aspects, the present invention specifically relates to a new and improved construction of a ledge for a sheet forming zone of a double wire papermaking machine and which ledge is arranged substantially transverse to the machine direction in a substantially flexure resistant manner. The ledge is adjustable for guiding the sieves or screens or wires between which a sheet is formed from a web of material. A guide surface facing the wires, is provided at the ledge.

During the manufacture of paper or cardboard the stock suspension which is infed between the sieves or screens or wires of the papermaking machine, is subjected to pressures which vary in the machine direction. The aqueous portion of the stock suspension is withdrawn through the sieves or screens or wires and a sheet is formed therebetween. The pressure variations are necessary in order to prevent flocculation of the fibers. The pressure variations are favorable for accomplishing satisfactory sheet formation.

For this purpose, there are frequently provided pressing units above and below the sieves or screens or wires and such pressing units are equipped, as viewed in the machine direction, with a series arrangement of a predeterminate number of ledges disposed substantially transverse to the machine direction. Constructions of this type are known from, for example, German Patent No. 3,153,305, published Oct. 23, 1986, and cognate with U.S. Pat. No. 4,447,295, granted May 8, 1984, German Patent No. 3,503,242, published June 16, 1988, European Published Patent Application No. 0,160,615, published Nov. 6, 1985, German Published Patent Publication No. 3,815,316, published Nov. 16, 1989, and German Published Patent Application No. 3,830,683, published May 11, 1989, which is cognate with the cross-referenced U.S. application Ser. No. 07/391,573, filed June 26, 1989.

In the hitherto known constructions, an abrupt and high pressure surge occurs at each one of the ledges so that, in extreme conditions, there can be destroyed the sheet or web which is already formed between the sieves or screens or wires, or the formed web or sheet can be crushed. Particularly, wide-ranging irregularities in the weight per unit area of the web or sheet or the presence of fiber flocks therein may result in local crushing due to an excessively steep pressure gradient in the forming region. Formation of the web or sheet is thereby impaired and also the strength values or data of the web or sheet decisively deteriorate under such conditions.

Developments hitherto undertaken aim at reducing such problems during use of the ledges. Therefore, there have been suggested ledges having appropriately formed contours of the guide surface which faces the sieves or screens or wires whereby there is intended a small pressure surge at the infeed into the region of the ledge. However, a desirable success in this respect cannot be achieved solely through this measure. Furthermore, the hitherto proposed measures for adjusting the ledges relative to the sieves or screens or wires impede the effects which can be expected as a result of appropriate shaping of the guide surface because, due to the adjustment, the spacings between the sieves or screens or wires and the guide surface are eventually substantially changed along the contour of the guide surface.

SUMMARY OF THE INVENTION

Therefore, with the foregoing in mind, it is a primary object of the present invention to provide a new and improved construction of the ledge or ledge arrangement for a sheet forming zone of a papermaking machine and which ledge is not afflicted with the aforementioned drawbacks and limitations of the prior art constructions heretofore discussed.

Another significant object of the present invention is directed to the provision of a new and improved construction of a ledge or ledge arrangement for a sheet forming zone of a papermaking machine and which ledge permits maintaining small the pressure surges at the infeed in the region of the ledge in the presence of an appropriate contour configuration of the guide surface.

A further important object of the present invention is directed to providing a new and improved construction of a ledge or ledge arrangement for a sheet forming zone of a papermaking machine and which ledge permits maintaining small the pressure surges at the infeed in the region of the ledge in the presence of an appropriate contour configuration of the guide surface and which effect on the pressure surge is maintained during operation of the papermaking machine also during or upon adjustment of the ledge.

A still further noteworthy object of the present invention is directed to the provision of a new and improved construction of a ledge or ledge arrangement for a sheet forming zone of a papermaking machine and which ledge can be employed already at low consistencies or dry content of the material to be processed in the absence of any crushing of the web of material.

Still a further significant object of the present invention aims at providing a new and improved construction of a ledge or ledge arrangement for a sheet forming zone of a papermaking machine which during its use enables satisfactory forming operation for producing a formed paper sheet or web of the best possible quality and translucency.

Yet a further significant object of the present invention is related to the provision of a new and improved ledge for a sheet forming zone of a papermaking machine and which ledge is adjustable by adjusting means which have a relatively simple construction and are reliable in operation.

Now in order to implement these and still further objects of the invention, which will become more readily apparent as the description proceeds, the ledge or ledge arrangement of the present development is manifested, among other things, by the features that, the ledge contains a supporting member and a pressing member provided with the guide surface. The pressing member is adjustable relative to the sieves or screens or wires and relative to the supporting member by means of a pressing device which is supported at the supporting member and permits adjustment of the pressing member by substantially simultaneous elevational and inclination adjustment of the pressing member about a pivot axis which extends parallel to a direction defined by the ledge.

Due to the inventive mode of adjusting the ledge by substantially simultaneous elevational an inclination adjustment of the pressing member containing the appropriately configured guide surface, the intended spacings between the associated sieve or screen or wire and the guide surface are substantially maintained at all locations. Consequently, the desired pressure changes during and after adjustment of the pressing member are effected in any desired manner. As a result, the web of material which is present between the sieves or screens or wires can be pressure treated in a preserving manner so that the web of material is neither damaged nor negatively affected. This has the highly desirable effect that the inventive ledges already can be utilized at low consistencies or dry content of the web material in the sheet forming zone. There can thus be accomplished satisfactory formation to form a paper sheet or web having a ground or frosted glass-like translucency. Adjustment of the ledge is ensured by employing adjustment means which have been well tested for such purposes.

As alluded to above, the invention is not only concerned with the aforementioned structural aspects of the ledge, but also relates to a novel construction of a pressing unit for use with a double wire former of a papermaking machine.

To achieve the aforementioned measures, the inventive pressing unit, in its more specific aspects, comprises:

a predeterminate number of ledges which are series arranged with respect to the machine direction; and the predeterminate number of ledges are series arranged in a manner such as to permit substantially horizontal guidance of the sieves or screens or wires.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a partially sectional view of a sheet forming zone containing a first exemplary embodiment of the inventive ledge;

FIG. 2 is a partially sectional view of a sheet forming zone containing a second exemplary embodiment of the inventive ledge;

FIGS. 3 and 4 are schematic views showing further embodiments and arrangements of the inventive ledges in a sheet forming zone; and FIG. 5 is a partially sectional side view of an exemplary embodiment of the inventive pressing unit containing a plurality of ledges of the type as illustrated in FIGS. 1 to 3.

DETAILED DESCRIPTION OF THE PREFERRED EMBODIMENTS

Describing now the drawings, it is to be understood that to simplify the showing thereof, only enough of the construction of the ledge has been illustrated therein as is needed to enable one skilled in the art to readily understand the underlying principles and concepts of the present development, while simplifying the showing of the drawings.

Turning attention now specifically to FIG. 1 of the drawings, a sheet forming zone of a papermaking machine partially illustrated therein by way of example and not limitation will be seen to comprise a plural number of ledges or ledge arrangements 1. Each one of the ledges 1 is arranged substantially transverse to the machine direction as indicated by the arrow designated by the reference character A. Each ledge 1 is suitable for guiding sieves or screens or wires 2 and 3 between which a web 4 of material is formed by means of a variable pressure treatment caused by the ledges 1.

Each ledge 1 can be adjusted relative to the sieves or screens or wires 2 and 3 and is supported in a flexure or bending resistant manner at a member 12A of a pressing unit 12 which is of the type as illustrated in FIG. 5 of the drawings and which can be positioned relative to the sieves or screens or wires 2 and 3 or the material web 4. Each ledge 1 has a guide surface 5 which faces the sieves or screens or wires 2 and 3 and has an appropriate cross-sectional contour. Such contour shape or configuration is intended to prevent the occurrence of steep pressure gradients on the infeed side as well as on the outfeed side of the guide surface 5 whereby a pressure increase is intended to be achieved on the infeed side.

On the opposite side of the sieves or screens or wires 2 and 3 and which opposite side is remote from the guide surface 5 of each ledge 1, there are provided, in the illustrated example, support elements 14 which cooperate with the ledges 1 during the pressure treatment or processing of the material web 4.

More specifically, each ledge 1 comprises a supporting member 6 which is mounted at the member 12A of the pressing unit 12, and a pressing member 7 which contains the guide surface 5 having the aforementioned appropriate contour. The position of the pressing member 7 can be adjusted in a direction relative to the sieves or screens or wires 2 and 3 by means of a pressing device 8 which is supported at the supporting member 6. In the illustrated example, the pressing device 8 contains a pressing element 9 which is supported at the supporting member 6 and acts upon the pressing member 7 and which can be subjected to the pressure of a pressurizing medium or pressure fluid which may constitute, for example, a gas or a liquid. In the illustrated example, the pressing element 9 constitutes a hose which can be subjected to the pressure of the pressurizing medium or pressure fluid and thereby can be deformed. This hose is a least partially imbedded into the supporting member 6 so that its deformation which is caused by subjecting the hose to the pressure of the pressure fluid in the present instance, results in lesser or greater crowning in cross-sectional view and acts upon the pressing member 7 in order to position the same relative to the supporting member 6.

A connecting means or member 10 is provided between the supporting member 6 and the pressing member 7 of each ledge 1. The connecting means or member 10 causes, during movement, i.e. elevational movement of the pressing member 7 relative to the supporting member 6 by means of the pressing device 8, a substantially simultaneous inclination of the pressing member 7 or its guide surface 5 relative to the sieves or screens or wires 2 and 3 and to the supporting member 6 in a manner substantially corresponding to the aforenoted elevational movement. A pivot axis 15 of the pivoting movement or adjustment extends essentially parallel to a predetermined direction of the ledge 1.

As illustrated in FIG. 1 with respect to the first exemplary embodiment of the inventive ledge construction, the connecting means or member 10 may be made of the same material as the pressing member 7 and, in effect, may constitute a portion of the pressing member 7 and contain a bend which acts in the manner of or represents the aforementioned pivot axis 15. This is particularly preferable if the pressing member 7 is made of plastics material such as, for example, polyethylene. As illustrated in FIG. 2 of the drawings with respect to the second exemplary embodiment of the inventive ledge construction, the connecting means or member 10 also can be made of two rotatably interengaging members which are respectively formed at the pressing member 7 and the supporting member 6 and which define a common pivot axis 15 about which the pressing member 7 can be rotated or pivoted. The same purpose can be achieved by using, for example, a blade spring at this location.

As can be seen in the figures of drawings, the pressing device 8 directly contacts the pressing member 7 and adjustably supports the pressing member 7 for adjustment relative to the wires and the supporting member 6 by permitting substantially simultaneous adjustment of the pressing member 7 in elevation and in inclination about a pivot axis 15, with the pivot axis 15 being located substantially at one end of the pressing member 7 with the pressing member 7 being mounted to rotate around the pivot axis 15.

The pressing member 7 can be made of a relatively soft, flexible plastics material. In such case it is recommended that the guide surface 5 be provided with an integrated abrasion-resistant layer formed by, for example, a ceramic insert at least in a section where the contour of the guide surface 5 can be expected to be subject to abrasion on the side of the associated sieve or screen or wire 2 or 3. In the exemplary embodiment illustrated in FIG. 2, the ceramic insert is designated by the reference character 11.

Advantageously, a predeterminate number of the ledges 1 of the type as described hereinbefore with reference to FIGS. 1 and 2 of the drawings, is employed in an exemplary embodiment of the inventive pressing unit 12 for a double wire former of a papermaking machine as illustrated in FIG. 5 of the drawings. In such pressing unit 12, the ledges 1 are series arranged with respect to the machine direction indicated by the reference character A in FIG. 1. The series arranged ledges 1 are collectively mounted at a common support structure 13, as also illustrated in FIG. 5 of the drawings.

The support structure 13 is constructed in a manner such as to enable positioning of the series arrangement of ledges 1 relative to the sieves or screens or wires 2 and 3 in elevation as well as in inclination. This purpose is served by the pressurizable beams 16 and guide means 17 which are provided at the support structure 13. It is of advantage for exchanging the ledges 1 in such pressure unit 12, if the ledges can be slid laterally into the support structure 13. For this purpose, there are provided mounting means constituting T-shaped guides 18 which are distinctly visible in FIGS. 1 to 4 of the drawings. Advantageously, also the pressing members 7 can be laterally slid into the support structure 13 relative to the supporting members 6 and separately therefrom. Thus it is rendered possible to use and to readily exchange pressing members 7 containing different guide surfaces 5 in correspondence with the momentary technological requirements.

The pressing members 7 can be pressed against the screens or wires 2 and 3. The pressure which is thus formed between the sieves or screens or wires 2 and 3 is absorbed by the support elements 14 which are provided on the side of the screens or wires 2 and 3 which is remote from the pressing member 7. As a result of the aforedescribed adjustment, the position of the pressing member 7 can be adapted to different heights or thicknesses of the stock suspension or material which is present between the screens o wires 2 and 3.

Upon a pressure increase in the pressing element 9, the associated screen or wire, namely the screen or wire 2 in the illustration of FIGS. 1 and 2, is increasingly pushed in a direction towards the support element 14. As a result, the stock suspension or material web 4 which is present between the screens or wires 2 and 3, is exposed to increased pressure. During this operation a forced-out aqueous portion of the stock suspension or material web 4 adheres to the screen or wire in the form of a film. This film is transported into an infeed wedge which is defined between the guide surface 5 and the screen or wire, approximately at the velocity of movement of the screen or wire. This film also is partially rearwardly deflected in this region. As a result, there is produced a pressure increase in this region and such pressure increase causes a gentle pretreatment of the stock suspension or material web 4 which is present between the screens or wires 2 and 3. A portion of the film is entrained between the screen or wire and the guide surface 5 in the manner of a slide film and is withdrawn at the end or on the outfeed side of the guide surface 5. When the papermaking machine is operated at higher screen or wire velocities, then, the pressure prevailing in the pressing element 9 is simply increased.

The contour of the guide surface 5 ascends as viewed in the machine direction A and thus forms the aforementioned pressure wedge conjointly with the screen or wire. The appropriately configured contour of the guide surface 5 may contain straight or flat, concave or convex sections. In a front region or location 5A, as viewed in the machine direction, at which the guide surface 5 first contacts the associated screen or wire, namely the screen or wire 2 shown in FIGS. 1 and 2 of the drawings, the related contour section forms an acute angle with the screen or wire 2 in the range of 10 minutes to 20 degrees. It should be noted in this context that the contour may also have a stepwise configuration. The actual pressing surface of the contour and which pressing surface is swept or engaged by the screen or wire 2, may have a straight or flat configuration or an arcuate, i.e. concave or convex configuration. The contour may also comprise one or more lines of inflexion or turning. Of all these possibilities of appropriately configuring the contour of the guide surface 5, there are only shown some configurations in FIGS. 1 to 4 of the drawings merely as a matter of example.

The inventive ledges can be utilized in conjunction with the pressing unit 12 which may act upon the sieves or screens or wires 2 and 3 either from below, as illustrated in FIGS. 1 and 2 of the drawings, or from above. The latter arrangement is illustrated in the exemplary embodiments of FIGS. 3 and 4 of the drawings. The side of the support element 14 opposite to the ledges 1 may have any known contour or contours. There can be provided, for example, a flat, convex or concave, stationary shoe, an open or closed forming roll or a suction roll. The inventive ledges 1 can be employed in conjunction with substantially all known former constructions, for example, in conjunction with the double wire former of the type as known from German Published Patent application No. 3,830,683. It is a very great advantage of the inventive ledge construction that there can be adjusted, along the sheet forming zone, different treatment zones in comparatively simple manner. Thus, for example, it can be frequently advantageous to adjust or utilize a more gentle forming zone in the starting region and a less yielding forming zone in the end region of the entire former construction.

When using the inventive ledges 1, the pressure gradient on the infeed side to the ledge 1 and the pressure between the sieves or screens or wires 2 and 3 in the sheet forming zone can be adjusted in any desired manner with respect to any existing dewatering requirement so that there can be accomplished an optimum and uniform forming operation. Consequently, the inventive ledges 1 can also be used in the front or starting region of the sheet formation in combination with a double wire former where the material web 4 has low consistency or dry content and during such use there is avoided the risk of crushing the web 4. In this manner there can be obtained a sheet quality in excess of the hitherto obtainable quality such as, for example, ground or frosted glass-like translucency in the absence of any loss or reduction in the web or sheet strength.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A ledge arrangement for a sheet forming zone of a double wire papermaking machine defining a predetermined machine direction, comprising:

means for arranging the ledge arrangement in a substantially flexure resistant manner substantially transverse relative to the predetermined machine direction;

adjusting means for adjusting the ledge arrangement for guiding wires of the papermaking machine and between which wires a sheet is formed from an infed web of material;

a guide surface facing the wires;

supporting member;

a pressing member containing said guide surface facing said wires;

said adjusting means including a pressing device;

said pressing device being supported at said supporting member and adjustably supporting said pressing member;

a predetermined ledge direction defined by the ledge arrangement; and said pressing device directly contacting said pressing member and adjustably supporting said pressing member for adjustment relative to said wires and said supporting member and structured and arranged to permit substantially simultaneous adjustment of the pressing member in elevation and in inclination about a pivot axis, said pivot axis being located substantially at one end of said pressing member with said pressing member being mounted to rotate around said pivot axis.

2. The ledge arrangement as defined in claim 1, further including:

a pressing element of said pressing device;

said pressing element being subjectable to a pressure fluid; and said pressing element being supported at said supporting member and acting upon said pressing member.

3. The ledge arrangement as defined in claim 2, wherein:

said pressing element constitutes a hose;

said hose being subjectable to said pressure fluid and being deformable under the action of said pressure fluid; and said hose being at least partially imbedded in said supporting member and acting upon said pressing member through its deformation.

4. The ledge arrangement as defined in claim 1, wherein:

said guide surface defines, as viewed in said predetermined machine direction, a front region adapted to make first contact with one of said wires during operation of the papermaking machine; and said front region of said guide surface at said pressing member adapted to form conjointly with said one wire an angle in the range of 10 minutes to 20°.

5. The ledge arrangement as defined in claim 4, in combination with a double wire papermaking machine.

6. The ledge arrangement as defined in claim 1, in combination with a double wire papermaking machine.

7. The ledge arrangement as defined in claim 1, wherein said pivot axis is formed on a connecting means provided between said supporting member and said pressing member; and said connecting means permitting, during adjustment of said pressing member relative to said supporting member by means of said pressing device, adjustment to an angle of inclination of the pressing member with respect to a horizontal plane passing through said pressing member as well as between said pressing member and said supporting member.

8. The ledge arrangement as defined in claim 1, further including:

a ceramic insert integrated with a predetermined section of said guide surface; and said ledge being made of plastics.

9. The ledge arrangement as defined in claim 8, wherein:

said ledge is made of polyethylene.

10. A pressing unit for a double wire former of a papermaking machine defining a predetermined machine direction, comprising:

a plurality of ledges;

a support structure for collectively supporting said plurality of ledges;

said plurality of ledges being series arranged with respect to the machine direction at said support structure;

positioning means for positioning said support structure in elevation and in inclination relative to a double wire of the double wire former;

each one of said plurality of ledges comprising;

means for arranging the ledge in a substantially flexure resistant manner substantially transverse relative to the predetermined machine direction;

adjusting means for adjusting the ledge for guiding wires of the papermaking machine and between which wires the sheet is formed from an infed web of material;

a guide surface facing the wire;

a supporting member;

a pressing member containing said guide surface facing said wires;

a pressing device of said adjusting means;

said pressing device being supported at said supporting member and adjustably supporting said pressing member;

a predetermined ledge direction defined by the ledge; and said pressing device directly contacting said pressing member and adjustably supporting said pressing member for adjustment relative to said wires and said supporting member and structured and arranged to permit substantially simultaneous adjustment of the pressing member in elevation and in inclination about a pivot axis, said pivot axis being located substantially at one end of said pressing member with said pressing member being mounted to rotate around said pivot axis.

11. The pressing unit as defined in claim 10, further including:

mounting means for mounting said plurality of ledges at said support structure and permitting laterally sliding of said predetermined number of ledges into said support structure; and said pressing member of each one of said plurality of ledges being mounted by sliding said pressing member onto said supporting member.

12. A pressing unit for a double wire former of a papermaking machine defining a predetermined machine direction, comprising:

a plurality of ledges series arranged with respect to the predetermined machine direction;

said plurality of ledges being series arranged for substantially horizontally guiding wires of the double wire former of the papermaking machine;

each one of said plurality of ledges comprising:

means for arranging the ledge in a substantially flexure resistant manner substantially traverse relative to the predetermined machine direction;

adjusting means for adjusting the ledge for guiding wires of the papermaking machine and between which wires the sheet is formed from an infed web of material;

a guide surface facing the wires;

a supporting member;

a pressing member containing said guide surface facing said wires;

a pressing device of said adjusting means;

said pressing device being supported at said supporting member and adjustably supporting said pressing member;

a predetermined ledge direction defined by the ledge; and said pressing device directly contacting said pressing member and adjustably supporting said pressing member for adjustment relative to said wires and said supporting member and structured and arranged to permit substantially simultaneous adjustment of the pressing member in elevation and in inclination about a pivot axis, said pivot axis being located substantially at one end of said pressing member with said pressing member being mounted to rotate around said pivot axis.

* * * * *